US006254680B1

(12) United States Patent
Fligge et al.

(10) Patent No.: US 6,254,680 B1
(45) Date of Patent: Jul. 3, 2001

(54) DEVICE FOR HOT-DIP COATING METAL BAND

(75) Inventors: Aribert Fligge, Gelsenkirchen; Klaus Frommann, Meerbusch; Walter Ottersbach, Duisburg, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/214,482

(22) PCT Filed: Jul. 1, 1997

(86) PCT No.: PCT/DE97/01412

§ 371 Date: Feb. 9, 1999

§ 102(e) Date: Feb. 9, 1999

(87) PCT Pub. No.: WO98/01595

PCT Pub. Date: Jan. 15, 1998

(30) Foreign Application Priority Data

Jul. 5, 1996 (DE) ..... 196 28 512

(51) Int. Cl.[7] ..... B05C 3/02
(52) U.S. Cl. ..... 118/405; 118/419
(58) Field of Search ..... 427/431, 433, 427/434.7, 436; 118/405, 419, 423

(56) References Cited

U.S. PATENT DOCUMENTS 3,090,352 * 5/1963 Knapp .
5,702,528 * 12/1997 Paramonor et al. .
5,827,576 * 10/1998 Carter et al. ..... 118/419
5,965,210 * 10/1999 Tada et al. ..... 118/405

FOREIGN PATENT DOCUMENTS

4344939 * 2/1995 (DE) .
9603533 * 2/1996 (WO) .

* cited by examiner

*Primary Examiner*—Brenda A. Lamb
(74) *Attorney, Agent, or Firm*—Cohen, Pontani, Lieberman & Pavane

(57) ABSTRACT

The invention relates to an apparatus for coating a metal strip passed through a container which holds the melted coating material. A channel is connected to the container which encloses the material in the form of a strip beneath the melt bath level. Channel currents are induced in the coating material by means of inductors and cause an electromagnetic force in order to hold the coating material back. The channel is attached to the base of the container such that it is easily detachable and comprises a plurality of parts which can be separated in the strip running direction, are sealed with respect to one another and can individually be moved away from the strip, transversely with respect to the strip running direction, to replace the channel with the strip located in it, after releasing the separation connection.

7 Claims, 1 Drawing Sheet

DEVICE FOR HOT-DIP COATING METAL BAND

BACKGROUND OF THE INVENTION

1. Field of the Invention

The invention relates to an apparatus for coating a metal strip that is passed through a container which holds the melted coating material and, underneath the melt bath level, has a channel which encloses the material in the form of strip, in which channel currents are induced in the coating material by means of inductors and cause an electromagnetic force in order to hold the coating material back.

2. Description of the Prior Art

A system of this generic type prior art apparatus for coating a metal strip is described, for example, in German Patent 43 44 939. The container which holds the coating material in the form of a melt there is provided with an opening ac the base for the strip to be coated to pass through. This opening is sealed by an electromagnet pump with produces an electromagnetic force equal in magnitude to or greater than the metallostatic pressure in the opening of the through-channel. In consequence, the liquid coating material is prevented from running out through the through-channel.

The through-channel is subject to stringent thermal requirements and, accordingly, is subject to wear. For this reason, the channel has to be replaced. Replacement of an integral channel requires that there no longer is any strip in the channel and that the strip must be threaded through the channel once again after replacement of the worn components. The separation and renewed threading in of the strip is very time-consuming and difficult, and considerably interferes with the productivity of the system as a result of long down times.

SUMMARY OF THE INVENTION

The object of the present invention is to improve an apparatus of this generic type for coating material in the form of strip, such that the channel can be replaced quickly with minimized system down times, without the strip having to be cut through.

In order to achieve this object, it is proposed according to the invention that the channel is attached to the base of the container such that it is easily detachable and comprises a plurality of parts which can be separated in the strip running direction. The plurality of parts are sealed with respect to one another and can individually be moved away from the strip, transversely with respect to the strip running direction, in order to replace the channel with the strip located in it, after releasing the separation connection.

The essence of the present invention is to design the channel from parts which can be separated from one another and can be moved away from the strip for replacement of the channel, without the strip itself having to be separated or unthreaded. The channel or the parts of the channel are thus attached to the base of the container which holds the coating material such that they are easily detachable and can be moved away in a very short time once the container has been emptied. In the same way, new channel parts can be brought into position and joined together to form a new channel, so that a closed channel surrounding the strip is produced. The separable parts are sealed with respect to one another by means of suitable sealants and, in the operating state, close the channel in a liquid-tight manner.

In one embodiment of the invention, the channel is composed of an electrically insulating material having a good surface wetting capability, the channel preferably being formed ceramic material. In terms of its surface characteristic and structure, the ceramic material is designed such that the surface is wetted by the liquid coating metal. The inductors, which enclose the channel on both sides, ire particularly highly effective when the electrically insulated ceramic material is used.

In order to replace the channel parts, they may be attached to the inductors and moved or displaced together with them. This means that, in order to replace the channel parts and to open the sealed channel, the inductors (for example guided on rollers) may be moved transversely with respect to the strip and carry the separated channel parts with them when they move.

According to another embodiment of the invention, the channel parts may also be arranged such that they can be moved or displaced in the system independently of the inductors arid, for example for replacement of the channel, the inductors may be moved first, with the channel parts being displaced in a second process step.

For the coating process, it is advantageous if the channel is sealed such that It can be closed in a gastight manner with barrier gas applied to it.

The channel, maybe held on the container base by means of wedges or eccentrics for quick detachment. Once the wedges have been released or the eccentrics moved out of the way, the channel can quickly be moved to its removed position. In any case, the strip remains in its central position, while the channel is removed by splitting it into channel parts.

A further feature of the invention includes a roller arrangement for guiding and centering the strip provided underneath the channel.

The present invention allows the channel parts to be replaced quickly without previously removing the strip, and considerably reduces the system down times. In consequence, system productivity can be improved, with the quality of the coated strip metal being increased at the same time since the simplified quick replacement of the worn channel parts means that non-uniformities in the coating caused by channel replacement are kept at a very low level.

BRIEF DESCRIPTION OF THE DRAWINGS

An exemplary embodiment of the invention is described in the following text and illustrated in the drawing, in which.

DETAILED DESCRIPTION OF THE PREFERRED EMBODIMENTS

Figure 1:
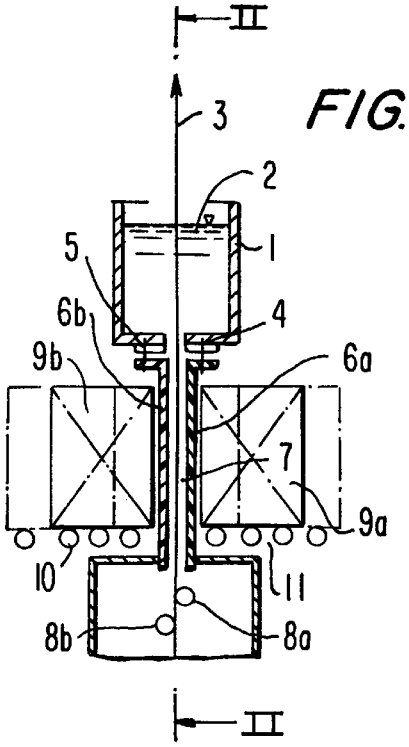
FIG. 1 is a schematic diagram showing a longitudinal section of an apparatus according to the invention for hot-dip coating of strips.

In FIG. 1, a container 1 holds melted coating material 2. A strip, 3 is passed through the container 1 from bottom to top in the direction of the arrow and, in the process, is coated with the coating material 2. An attachment apparatus 5 for channel parts 6*a* and 6*b* of the channel, is arranged at a base 4 of the container 1, with the strip 3 being passed through channel such that it is centered. Rollers 8*a,* 8*b* in the inlet region of the channel 7 ensure that the strip is guided in a stable manner, resulting in the strip being held in a centered position. Inductors 9*a,* 9*b* are arranged on both sides of the channel 7 and—as can be seen in the dashed-dotted illustration—can be moved away from the channel 7 on both sides on rollers 10 which, for their part, roll on guide tracks 11.

Figure 2:
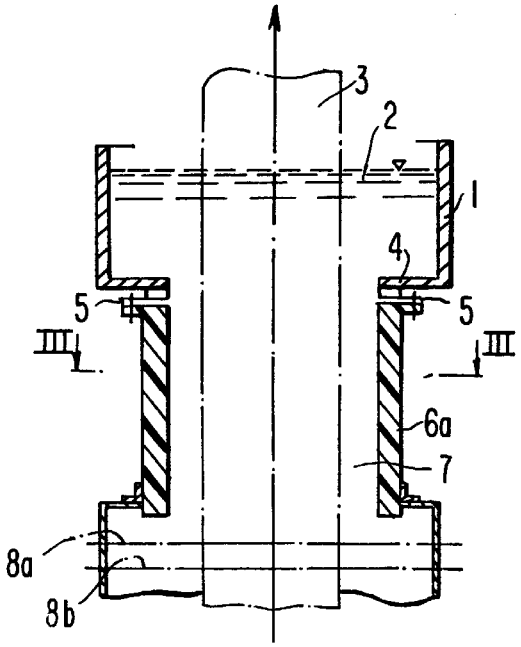
FIG. 2 shows the apparatus according to FIG. 1 along section line II—II.

In FIG 2, identical parts have the same designations, and it can be seen that the channel 7 has a rectangular cross section, with the cross section opening being dependent on the thickness and width of the strips 3 to be coated.

Figure 3A:
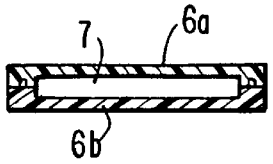
FIGS. 3*a–d* show cross sections along line III—III of FIG. 2 through various embodiment of split channels.
Figure 3B:
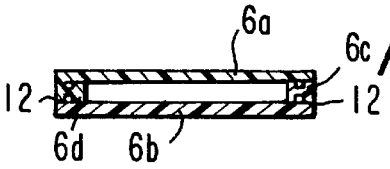
Figure 3C:
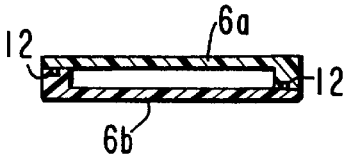
Figure 3D:
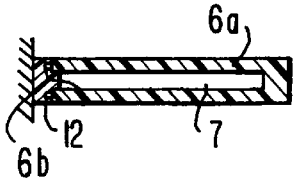

As can be seen in FIG. 3*a*, the channel 7, which is illustrated in cross section along line III—III of FIG. 2, is composed of at least two parts 6*a,* 6*b* which are connected to one another by suitable heat-resistant seals 12 to form a closed channel 7. In FIG. 3*b*, the channel 7 comprises four parts, namely the broad sides 6*a,* 6*b* and the end faces 6*c,* 6*d* which close the broad sides, sealing them, and are in turn sealed with heat-resistant seals 12 with respect to the broad sides. In the exemplary embodiment in FIG. 3*c*, the channel 7 comprises two separable parts, which are each of L-shaped design, one limb of the L-shaped cross section forming the end wall of the channel with respect to the other limb, and the two limbs being sealed with respect to one another with heat resistant seals 12. In the exemplary embodiment in FIG. 3*d*, a two-piece channel 7 is once again provided wherein of the end walls is a fixed channel part 6*b*, that is to say stationary on a system part which is not designated in any more detail, while the other channel part 6*a* is fitted over the strip and is connected in a sealed manner to the fixed channel part by heat resistant seals 12.

Figure 4:
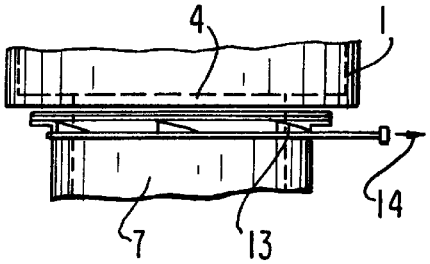
FIG. 4 shows an embodiment of an attachment of the channel on the container base.

FIG. 4 indicates schematically how, for example, the channel 7 is fixed on the base 4 of the container 1, namely via wedges 13 which engage with one another and are operatively connected to the another by moving the channel 7 in the direction of the arrow 14. In this way, the channel 7 can be connected to the base 4 of the container 1 very quickly, and can likewise be detached quickly.

The advantage of the present invention is that the channel 7, which is composed of two or more parts, does not require the strip metal located in the system to be separated to replace the channel, and the system availability is accordingly increased. Forming the channel from two or more parts which can be separated in the strip running direction enables the disassembly of the channel with the strip located in it. The replacement of the channel in a very short time is further enabled by means of quick connection elements. Suitable sealing elements or materials are inserted between the channel parts, preventing the liquid metal from flowing out during operation. The channel 7 can advantageously be heated via the inductors if, after replacement of the channel, the channel needs to be prepared for a new operating cycle.

What is claimed is:

1. An apparatus for coating a strip material, comprising:

a container for holding a metal melt of a coating material and having a base at a bottom of said container, said strip passable through said container from said base at said bottom of said container to a top of said container for receiving a layer of said coating material;

a channel portion detachably connected to said base of said container beneath said metal melt comprising a plurality of separable parts, said plural separable parts being sealable in a connected position in which said channel portion encloses said strip and said plural separable parts being individually removable transversely from said strip, thereby allowing replacement of said channel portion while said strip is in said channel portion, wherein said plural separable parts of said channel portion are sealable by a gas tight seal, and wherein barrier gas is applicable to said gas tight seal; and inductors operatively connected proximate said channel for inducing channel currents in said channel portion for preventing the metal melt of coating material in said container from entering said channel portion.

2. The apparatus of claim 1, wherein said channel portion comprises an electrically insulating material having a good surface wetting capability.

3. The apparatus of claim 1, wherein said channel portion comprises a ceramic material.

4. The apparatus of claim 1, wherein each said inductors is connected to one of said plural separable parts of said channel portion so that said inductors are movable with said plural separable parts.

5. The apparatus of claim 1, wherein said plural separable parts are movable independent from said inductors.

6. The apparatus of claim 1, further comprising one of wedges and eccentrics connected at said base of said container for detachable connecting said channel portion to said container.

7. The apparatus of claim 1, further comprising a roller arrangement mounted beneath said channel portion for guiding and centering said strip through said channel portion.

* * * * *